US005934022A

United States Patent [19]

Faubert

[11] Patent Number: 5,934,022

[45] Date of Patent: Aug. 10, 1999

[54] SLIDING DOOR LOWER TRACK STABILIZER

[75] Inventor: Robert J. Faubert, Rochester Hills, Mich.

[73] Assignee: Chrysler Corporation, Auburn Hills, Mich.

[21] Appl. No.: 09/119,931

[22] Filed: Jul. 21, 1998

[51] Int. Cl.[6] ..... E05F 11/00

[52] U.S. Cl. ..... 49/360; 49/279

[58] Field of Search ..... 49/279, 360, 459; 403/52; 384/34, 42

[56] References Cited

U.S. PATENT DOCUMENTS

| | | | |
|---|---|---|---|
| 1,924,419 | 8/1933 | Sinden | 49/279 |
| 3,501,865 | 3/1970 | Hormann | 49/360 |
| 4,569,553 | 2/1986 | Speth et al. | 296/155 |
| 4,901,421 | 2/1990 | Takarabe et al. | 384/34 X |
| 5,360,272 | 11/1994 | Schmale et al. | 384/34 X |
| 5,398,988 | 3/1995 | DeRees et al. | 296/155 |
| 5,580,180 | 12/1996 | DeBisschop et al. | 403/52 X |
| 5,832,668 | 11/1998 | Faubert et al. | 49/215 |

*Primary Examiner*—Daniel P. Stodola
*Assistant Examiner*—Hugh B. Thompson
*Attorney, Agent, or Firm*—William J. Coughlin

[57] ABSTRACT

An apparatus that stabilizes vehicle sliding doors when transitioning to and from a closed position, wherein the sliding door is guided along a track by a guide wheel contacting internal surfaces of the track. The apparatus stabilizes the sliding door by limiting movement of the guide wheel in cross-car and vertical directions. The apparatus is coupled to the track and limits movement of the guide wheel by contacting a shaft of the guide wheel as well as top and bottom surfaces of the guide wheel. Shaft and bottom surface contact is provided by a plurality of parallel members extending along a first and second side of the shaft of the guide wheel. Top surface contact of the guide wheel is provided by a longitudinal member, preferably having a longitudinal cavity for energy absorption and dissipation. The plurality of parallel members further define a curved receptacle which substantially mates with the shaft of the guide wheel. Thus, when the sliding door is transitioning to and from the closed position, improved alignment as well as increased energy absorption are achieved. Furthermore, the unified structure of the lower track stabilizer improves cost effectiveness by reducing manpower and component costs.

9 Claims, 2 Drawing Sheets

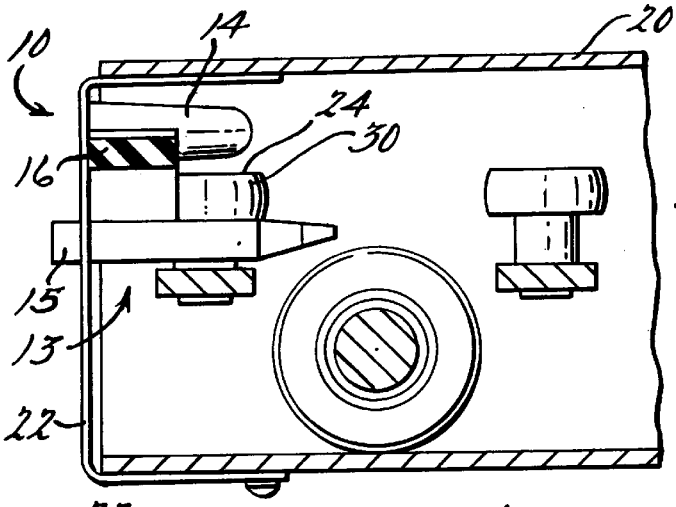
FIG. 4.
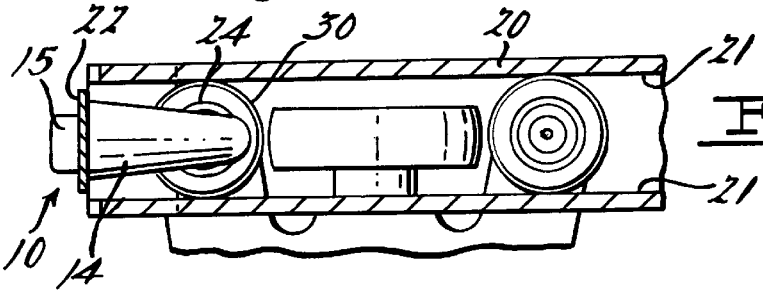
FIG. 5.
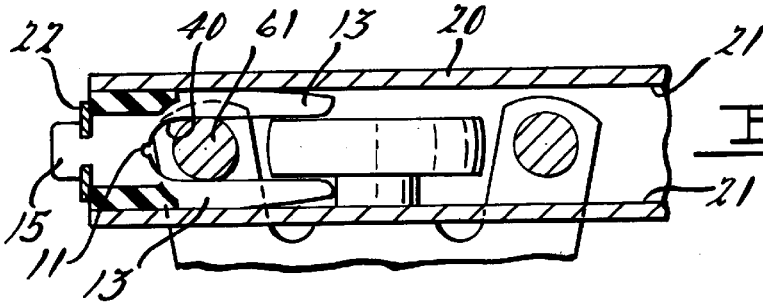
FIG. 6.
FIG. 7A.
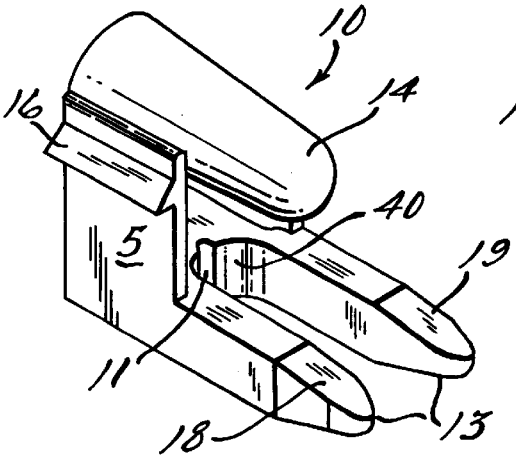
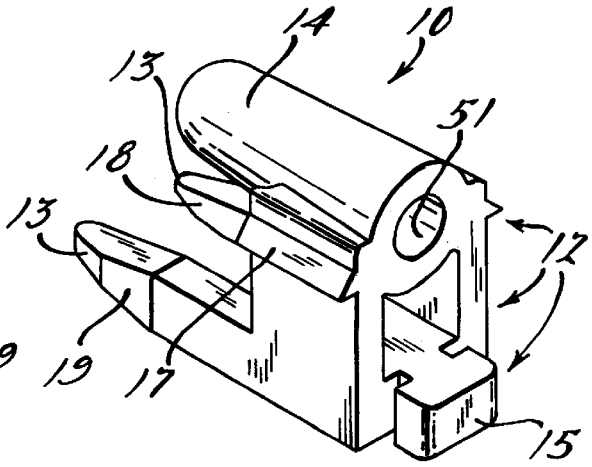
FIG. 7B.

SLIDING DOOR LOWER TRACK STABILIZER

BACKGROUND OF THE INVENTION

1. Technical Field

The present invention generally pertains to a sliding door assembly for a motor vehicle and a related method. More particularly, the present invention relates to a method and apparatus for stabilizing sliding door movement which incorporates a unified molded structure coupled to a track for guiding the sliding door.

2. Discussion

In the automotive industry, sliding doors have become a standard means of providing passenger access to high occupancy vehicles such as minivans. A typical sliding door assembly includes a hinge assembly connecting the sliding door to a track. The track generally extends along the side of the vehicle and can be located in a number of positions. For example, a lower track is often positioned along a lower edge of the vehicle, and curves beneath the passenger compartment at the front end. The sliding door is generally guided along the track by a plurality of guide wheels contacting internal surfaces of the track, at least one of which contacting internal lateral surfaces. The ability of vehicle sliding doors to open and close easily and accurately is very important. A critical parameter affecting this ease and accuracy is the alignment of the sliding door with the body of the vehicle when transitioning to and from the closed position. For example, movement of the sliding door in either the lateral (cross-car) or vertical direction during this transition creates additional stress on the passenger and in surrounding parts, thereby even further reducing overall stability.

The response to this alignment problem has typically been to dispose a plurality of sliding door stabilizer halves along the forward facing perimeter of the sliding door, in conjunction with a corresponding plurality of body stabilizer halves along the vehicle body. The two sets of halves mate in a male/female fashion when the door is opening and closing, such that stabilization takes place at a moment just before the sliding door is closed and just after it is opened. This method of stabilization, however, presents several efficiency and functional problems. For example, a relatively large amount of labor is required to install the various halves associated with stabilization. Furthermore, numerous attachment and reinforcement parts are required in order for effective stabilization to take place. Functionality is further restricted by the fact that stabilization is taking place at the sliding door/vehicle interface rather than the point of continuous contact between the sliding door and the vehicle, namely, the sliding door track. For example, tolerances are difficult to maintain when the number of stabilizer halves is increased in the conventional design. Overslam protection, due to increased closing forces exerted by the passenger, is also difficult to achieve under such a means of stabilization because energy absorption is difficult to accomplish without negatively affecting mating of the sliding door with the vehicle.

SUMMARY OF THE INVENTION

It is a general object of the present invention to provide an apparatus for limiting movement of a sliding door while the sliding door is transitioning to and from a closed position, wherein the sliding door is guided along a track by a guide wheel contacting internal lateral surfaces of the track. The apparatus includes a means for limiting movement of the guide wheel such that movement of the sliding door is also limited, as well as a means for coupling the apparatus to the track.

It is another object of the present invention to provide a method for limiting movement of a sliding door while the sliding door is transitioning to and from a closed position, wherein the sliding door is guided along a track by a guide wheel contacting internal lateral surfaces of the track. The method includes the steps of contacting a shaft, a bottom surface, and a top surface of the guide wheel of the sliding door, such that movement of the sliding door also is limited.

In one form, the present invention provides a plurality of parallel members for contacting a shaft of the guide wheel, as a means for limiting lateral movement of the guide wheel such that lateral movement of the sliding door is also limited. The plurality of parallel members also provide vertical stabilization by contacting a bottom surface of the guide wheel. The present invention also provides a longitudinal member contacting a top surface of the guide wheel, for limiting vertical movement of the guide wheel such that vertical movement of the sliding door is also limited. Furthermore, a preferred embodiment of the present invention includes a means for coupling the apparatus to the track, such that lateral surfaces and a front surface of the track are contacted. The first parallel member and the second parallel member further define a curved receptacle which substantially mates with the shaft of the guide wheel. Air pockets are disposed throughout the apparatus in the form of cavities so that energy absorption and dissipation can be achieved with minimal structural modification. Parallel members have tapered ends to improve mating of the apparatus with the guide wheel. The curved receptacle further includes a notch to provide increased energy absorption, particularly in overslam situations. The integrated molded structure of the preferred embodiment therefore provides a highly functional and efficient means for stabilizing sliding doors.

Additional benefits and advantages of the present invention will become apparent to those skilled in the art to which this invention relates from a reading of the subsequent description of the preferred embodiment and the appended claims, taken in conjunction with the accompanying drawings.

BRIEF DESCRIPTION OF THE DRAWINGS

FIG. 4 is a sectional view along lines 4—4 of FIG. 3.

FIG. 5 is a sectional view along lines 5—5 of FIG. 3.

FIG. 6 is a sectional view along lines 6—6 of FIG. 3.

FIGS. 7A–B are perspective views of the preferred embodiment of the present invention.

DETAILED DESCRIPTION OF THE PREFERRED EMBODIMENT

Figure 1:
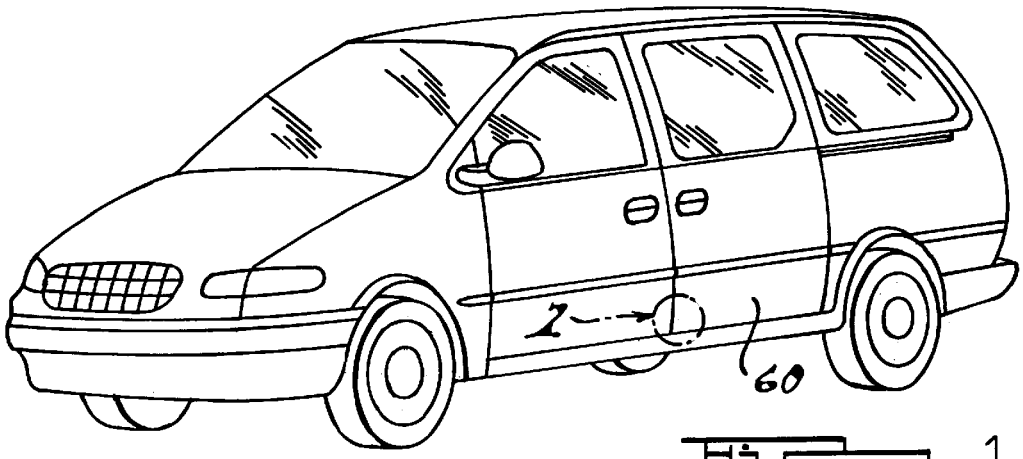
FIG. 1 is a perspective view showing a typical a sliding door environment.
Figure 2:
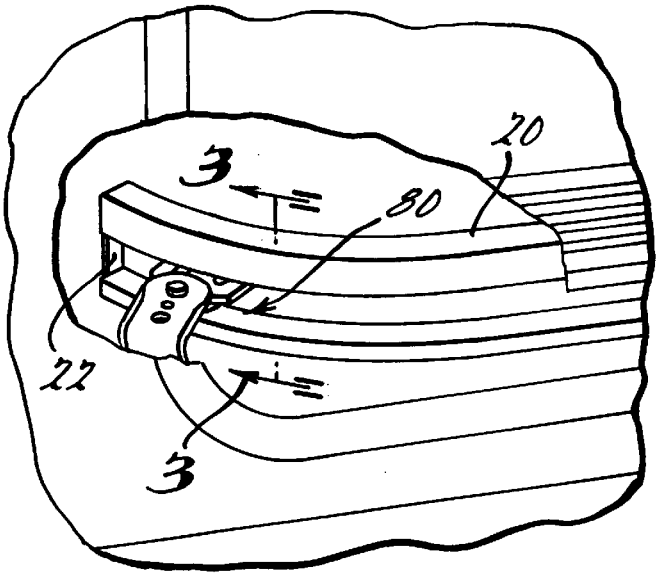
FIG. 2 is a cut-away view showing the location of a typical sliding door lower track and hinge assembly.

Referring to FIGS. 1–7, the present invention is a sliding door lower track stabilizer 10 for limiting movement of a sliding door 60 while the sliding door 60 is transitioning to and from a closed position. As shown best in FIG. 3, the sliding door 60 is guided along a track 20 by a sliding door assembly 80 having a guide wheel 30 which contacts internal lateral surfaces 21 of the track 20. FIGS. 7A–B show the stabilizer 10 as a unified molded structure preferably having a material composition of F104-536-L urethane, and comprising base 5, a means for coupling the apparatus to the track 20, and a means for limiting movement of the guide wheel 30. The means for limiting movement of the guide wheel 30 is positioned adjacent to internal surfaces 21 and 22 of the track 20, and includes a plurality of parallel members 13 extending from the base 5, and a longitudinal member 14 extending from the base 5. In a preferred embodiment, the means for coupling the apparatus to the track 20 includes a lateral surface locking mechanism for contacting lateral surfaces 21 of the track 20, and a front surface locking mechanism 15, for contacting a front surface 22 of the track 20. The lateral surface locking mechanism can be made up of a first lateral surface claw 16, and a second lateral surface claw 17 for coupling the stabilizer 10 to first and second lateral surfaces, respectively. It should be noted that any type of locking mechanism can be used to couple the stabilizer 10 to the track 20.

Figure 3:
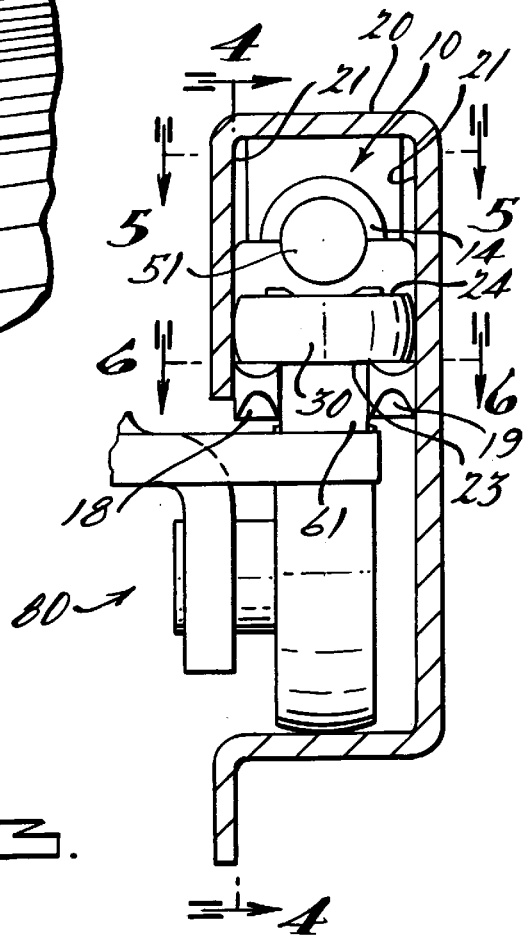
FIG. 3 is a sectional view along lines 3—3 of FIG. 2 showing the preferred embodiment of the present invention.

As best shown in FIG. 3, the plurality of parallel members 13 contact a shaft 61 of the guide wheel 30 of the sliding door 60 and serve as a means for limiting lateral movement of the guide wheel 30 so that lateral movement of the sliding door 60 is also limited. It should be noted that the plurality of parallel members 13 also contact a bottom surface 23 of the guide wheel 30 such that vertical movement of the guide wheel 30 is limited as well. The guide wheel 30 is therefore "sandwiched" between the plurality of parallel members 13 and the longitudinal member 14. The plurality of parallel members 13 includes a first parallel member 18, extending along a first side of the shaft 61 of the guide wheel 30, and a second parallel member 19, extending along a second side of the shaft 61 of the guide wheel 30. The stabilizer 10, the first parallel member 18, and the second parallel member 19 define a curved receptacle 40 which substantially mates with the shaft 61 of the guide wheel 30. Parallel members 18 and 19 have tapered ends to improve mating of the stabilizer with the guide wheel 30. The curved receptacle 40 further includes a notch 11 to provide increased energy absorption and dissipation. The longitudinal member 14 contacts a top surface 24 of the guide wheel 30 and serves as a means to limit vertical movement of the guide wheel 30 such that vertical movement of the sliding door 60 is also limited. The longitudinal member 14 is preferably cone shaped, so that stabilization of the guide wheel 30 increases as it moves toward the closed position at the front surface 22 of the track 20. Energy absorption is further increased by the longitudinal cavity 51 located in longitudinal member 14.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. An apparatus for limiting movement of a sliding door of a vehicle while the sliding door is transitioning to and from a closed position, comprising:

a track adapted to be connected to the vehicle;

a guide wheel adapted to be connected to the sliding door, such that the sliding door will be guided along the track to and from the closed position by the guide wheel, said guide wheel including a shaft;

and a stabilizer composed of:

a base;

a plurality of parallel members extending from the base, contacting the shaft of the guide wheel;

a longitudinal member extending from the base contacting a top surface of the guide wheel; and a means for coupling the stabilizer to the track, such that the plurality of parallel members and the longitudinal member are positioned adjacent to internal surfaces of the track.

2. The apparatus of claim 1 wherein the track has at least one lateral surface and an adjacent front surface and the means for coupling the stabilizer to the track comprises:

a lateral surface locking mechanism for coupling the stabilizer to the at least one lateral surface of the track; and a front su ace locking mechanism for coupling the stabilizer to the front surface of the track.

3. The apparatus of claim 2 wherein the lateral surface locking mechanist comprises:

a first lateral surface claw for coupling the stabilizer to a first lateral surface of the track; and a second lateral surface claw for coupling the stabilizer to a second lateral surface of the track.

4. The apparatus of claim 1 wherein the plurality of parallel members comprises:

a first parallel member extending along a first side of the shaft of the guide wheel; and a second parallel member extending along a second side of the shaft of the guide wheel.

5. The apparatus of claim 4 wherein the base, the first parallel member, and the second parallel member define a curved receptacle.

6. The apparatus of claim 5 wherein the curved receptacle has a notch.

7. The apparatus of claim 4 wherein the first and second parallel members have tapered ends.

8. The apparatus of claim 1 wherein the longitudinal member has a cone shape.

9. The apparatus of claim 1 further comprising a longitudinal cavity located within the longitudinal member.

* * * * *